United States Patent [19]

Hanson, Jr.

[11] 4,079,762

[45] Mar. 21, 1978

[54] SPIRALLY DISCHARGING NOZZLE AND POPPET VALVE FOR NON-SPLASH DISCHARGE OF LIQUIDS INTO CANS OR THE LIKE

[75] Inventor: Harold Wayne Hanson, Jr., Newport Beach, Calif.

[73] Assignee: Par-Way Mfg. Co., Los Angeles, Calif.

[21] Appl. No.: 726,274

[22] Filed: Sep. 24, 1976

[51] Int. Cl.[2] ..... B65B 3/22

[52] U.S. Cl. ..... 141/286; 141/392; 239/453; 239/460

[58] Field of Search ..... 141/1, 34, 286, 392, 141/301, 302, 367; 239/453, 460

[56] References Cited

U.S. PATENT DOCUMENTS

| | | | |
|---|---|---|---|
| 2,914,257 | 11/1959 | Wiant | 239/460 X |
| 3,189,284 | 6/1965 | Downey | 279/460 |
| 3,500,879 | 3/1970 | Meyer | 141/1 |

*Primary Examiner*—Richard E. Aegerter
*Assistant Examiner*—Frederick R. Schmidt
*Attorney, Agent, or Firm*—Forrest J. Lilly

[57] ABSTRACT

The application discloses a valve and nozzle device for filling liquid into open-top cans or other receptacles one at a time, travelling on a conveyor.

A commercial requirement is top speed achievable, and the conveyor moves the receptacles horizontally under a periodically discharging nozzle, which discharges a can-filling charge of liquid periodically, as rapidly as the can can be filled, and transported away to make room for the next charge. The apparatus disclosed discharges charges of liquid, under poppet valve control, through a discharge skirt formed to swirl each charge so that the charge impinges on the can, or can contents at a swirl angle, rather than straight down. By coordinating this swirl action with the downward velocity of the discharged charge, splash-out can be eliminated, and higher performance accomplished with a clean, non-splashing operation.

2 Claims, 6 Drawing Figures

SPIRALLY DISCHARGING NOZZLE AND POPPET VALVE FOR NON-SPLASH DISCHARGE OF LIQUIDS INTO CANS OR THE LIKE

FIELD OF THE INVENTION

This invention relates generally to the food canning industry, and more particularly to a nozzle for discharging a liquid food substance, such as brine, juices, sugar syrups or the like, into container cans or the like.

BACKGROUND OF THE INVENTION

In commercial packing, speed, i.e., the number of units per hour, is of course always a very important factor. In the past, charges of liquids, such as brine, juices, sugar syrups, etc., have been discharged, one at a time, into travelling container cans. A limitation on the speed of the operation has been that when the liquid is introduced into the can with more than a certain downward velocity, splash-out begins to occur, and becomes a severely limiting problem. The liquid is generally introduced in measured quantities under pump pressure, against a bias spring which yieldingly opposes opening of a poppet valve which discharges through a nozzle into successive cans. Earlier equipment for so doing is known in the art, and need not be described herein. The present invention deals with improvements in the final discharge nozzle, which, according to the prior art, is actuated periodically by intermittent openings against a bias spring of the poppet valve supplied periodically with a measured quantity of liquid; and particularly with a flared nozzle skirt associated with the nozzle and adapted to import a downward swirl, inside the skirt, to the liquid received from the poppet valve. Thus, by this means the downward component of discharge velocity into the can to be filled is lowered to the non-splash level.

The main achievement is in the creation of a swirl pattern which allows the liquid to enter the can, hitting the side walls at a substantial angle to vertical. If the liquid goes straight down, it has sufficient velocity to travel down the side wall, hit the bottom and splash back out. If it hits the side wall of the container and travels at a fair angle, it hits the bottom at a corresponding angle, diffuses the velocity of the liquid, and does not splash. Further, on larger volume charges of liquid, it creates a whirlpool vortex effect such as prevents splashing.

BRIEF DESCRIPTION OF THE DRAWINGS

In the drawings, showing a present illustrative embodiment and application of the invention.

DETAILED DESCRIPTION OF ILLUSTRATIVE EMBODIMENT OF INVENTION

Figure 1:
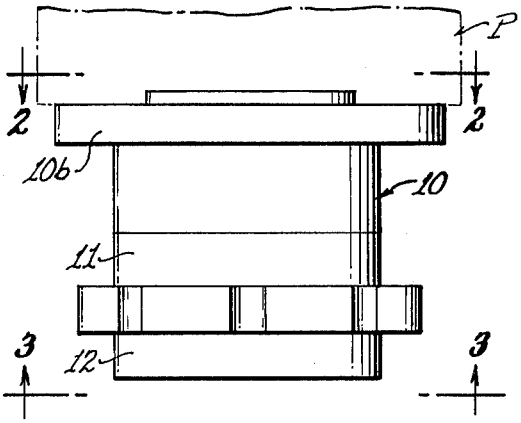
FIG. 1 is a side elevational view thereof.

In the drawings, numeral 10 designates the generally cylindric body of an illustrative embodiment of the invention. Screwed onto the reduced, externally screw threaded lower end portion 10*a* of this body 10 is nozzle or nozzle ring 11, whose lower end portion 12 is offset outwardly somewhat from the body 10. This wall 12 is in the form of a skirt, whose inner frusto-conical surface flares downwardly at a preferred acute interior angle of the order of 15° or thereabouts on a side. The interior angle of the skirt, however, when coordinated with the swirl angle of the liquid, which in turn depends upon the effective angle of skew of certain skewed or spirally directed grooves or vanes, other things being equal, governs the downward velocity and therefore splash characteristic of the nozzle.

The overall performance of the nozzle of the invention thus depends upon several factors in combination, among them the interior flare angle of the skirt, and the angle of skew of certain guide grooves or fins formed in the skirt. Virtually splash-free performance, at a very short cycle time duration (time for filling a can without splash) can thereby be achieved.

Returning now to the detailed description of the present structure, the body 10 has at the top a flange 10*b* for securement over the outlet of a fragmentarily indicated liquid pump P.

Figure 4:
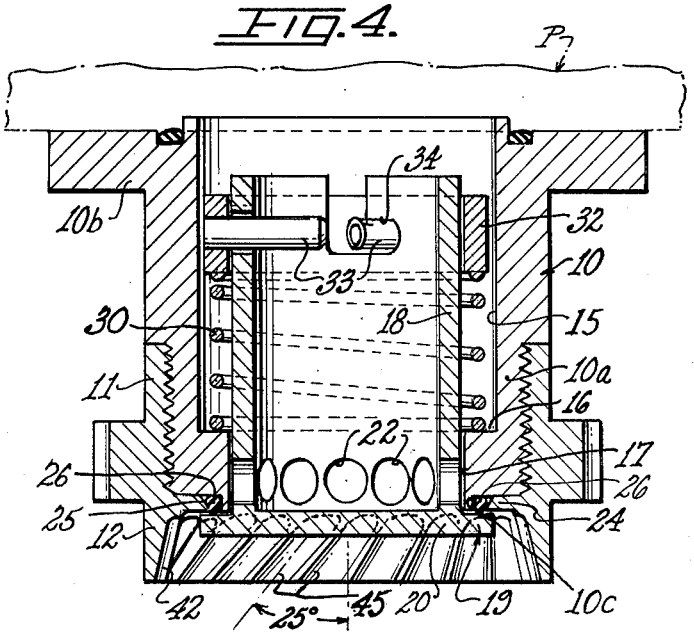
FIG. 4 is a longitudinal section taken as indicated by line 4—4 of FIg. 2.
Figure 6:
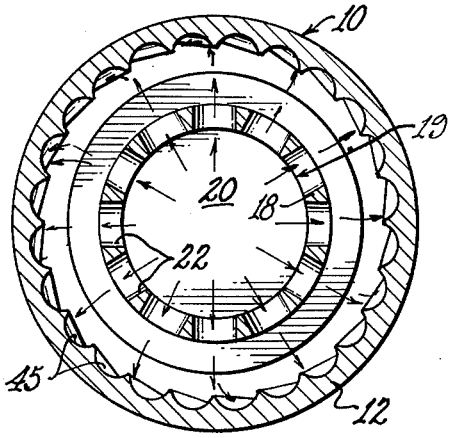
FIG. 6 is a transverse section taken on line 6—6 of FIG. 5.
Figure 5:
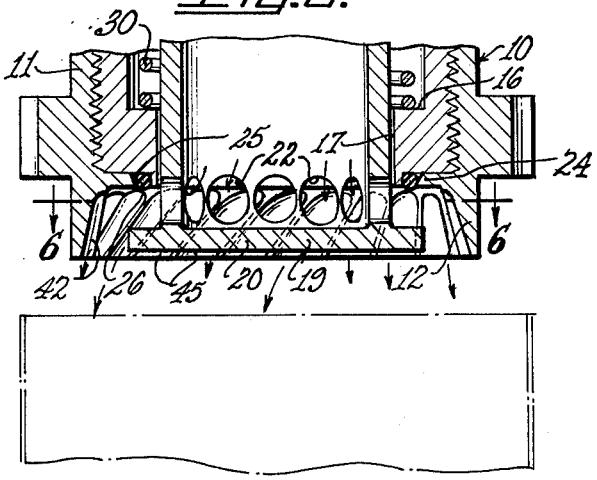
FIG. 5 shows the lower portion of FIG. 4, but in a valve open position, and showing also, fragmentarily and in phantom lines the upper portion of a can positioned for filling.

The cylindrical bore 15 of the body 10 is reduced at annular shoulder 16 to a reduced bore 17, which slidably receives, with a small clearance, a cylindrical tubular stem 18 of a poppet valve 19. The stem 18 is furnished at the bottom with an enlarged annular head or flange 20, and just above the latter, the stem 18 has a circumferential array of radial liquid discharge ports 22. These ports are withdrawn inside bore 17 in the valve-closed position of FIG. 4, and are thus covered over; and are positioned below and outside the lower end of the bore 17 in the downwardly extended, uncovered position of FIG. 5.

The nozzle ring 11 has an inwardly extending annular flange 24 with an upwardly facing bevelled edge 25, and the inner periphery of this flange 24, in the illustrative embodiment, just overhangs the outer periphery of the valve head or flange 20, though this is not an essential feature. The lower end portion of the cylindrical body 10 terminates in a short downwardly extending annular flange 10*c*, with a bore which comprises or is an extension of the lower end portion of bore 17, and whose length is equal to the thickness of flange 24. This flange formation entraps a rubber O-ring seal 26 which is exposed downwardly for sealing engagement by poppet valve head 20.

A coil compression spring 30, of properly selected spring rate, acts in compression between the flange or shoulder 16 on body 10 and the downwardly facing end or shoulder of a ring 32 which is telescopically loosely receivable on the upper extremity of poppet valve stem 18. This ring has inwardly projecting pins 33 engageable in bayonet slots 34 in the tubular valve stem 18. This arrangement yieldingly urges or biases the poppet valve head 20 upwards against its O-ring seal at or under the flange 24, against periodic pressurized liquid charges delivered from pump P during the duty cycle of the operation.

Figure 2:
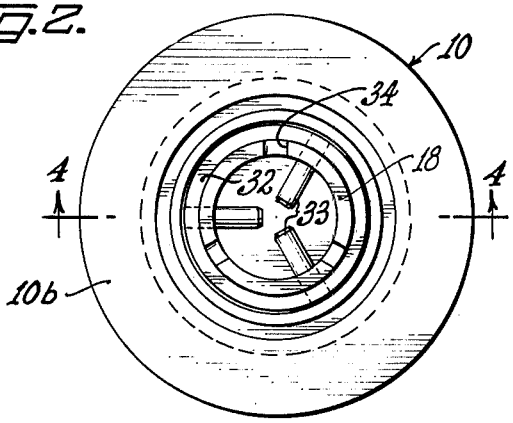
FIG. 2 is a transverse section taken on line 2—2 of FIG. 1.
Figure 3:
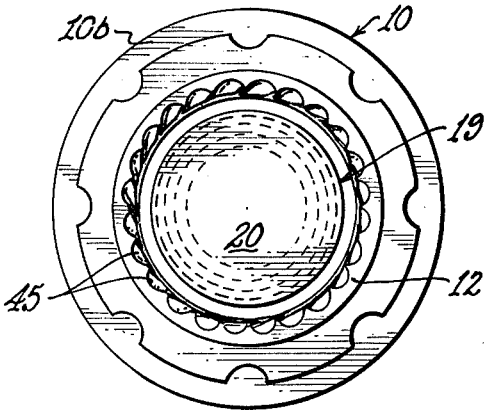
FIG. 3 is a bottom elevation, looking upwards in FIG. 1 as indicated by the line 3—3.

These liquid charges pass downwardly through the hollow stem 18, and exert downward force against poppet head 20. The total downward force so applied on the poppet valve is made to exceed the upward bias force exerted by the spring 30, so the poppet valve descends to the position of FIG. 2, in which fully open flow occurs radially outward from the ports 22. This flow then impinges radially outwardly against downwardly flaring internal skirt surface generally designated at 42.

The internal skirt surface in the nozzle may be of different angles to suit different situations, but in general, each side makes an acute angle with the vertical, in a useful range of the order of 15°. This skirt is provided with formations which receive the generally radial liquid flow from the uncovered ports just above the protruding lower end portion of the poppet valve (FIG. 2), and impart to it two components of flow, one vertically downward, and one directed spirally downward. In a present illustrative embodiment, I achieve a highly satisfactory pattern by using 24 generally spirally directed or skewed grooves 45. In the present embodiment, each has a 25° twist or skew angle displacement from upper end to lower end. In the present preferred embodiment, also, the grooves are preferably cut with a ball end mill having a cylindrical shank of the same diameter as the ball. At the upper end, just below the upper edge of the tapered skirt, this mill may be sunk laterally into the skirt about 0.25 of its diameter deep, and at the lower edge of the skirt, a little less deep, for example, about 0.35 of its diameter deep. The cross-sectional area of each groove increases from the inner or beginning ends of the grooves to the outer or inner ends thereof, so that the liquid, which tends to stay in its grooves through centrifugal force, is enabled to do so. The grooves are thus cut deeper at the lower end of the skirt, also making the grooves wider. This is done because of the greater circumference of the interior surface of the skirt as it extends downwards. The liquid discharges from the lower ends of the grooves as a hollow spinning cone, which is very well adapted to the present objective. Use of a tapered ball end mill is an equivalent alternative, provided that the desired expansion with increase in diameter of skirt is achieved. Depending upon the angle of the skirt, the number and angle of twist or skew of the grooves, the taper rates of the cross-sectional areas of the grooves as they traverse the skirt, and the specific gravity and viscosity of the liquid substance to be sprayed, downward and tangential velocity components of the discharging spray can be governed, and great rapidity of can filling, combined with non-splash filling, can be accomplished.

In the foregoing, the spiral liquid guide elements are described usually as grooves, but it will be understood that the spiral ribs between spiral grooves may alternatively be referred to with similar meaning.

What is claimed is:

1. In a device for periodically discharging a hollow cone of swirling liquid, under pressure, at a controlled spray velocity that will curtail undue splash from the bottom of a container being filled thereby, that comprises:

a generally cylindric vertically disposed hollow body having a main intake bore extending downwardly therein through its upper end, said body having a reduced bore extending coaxially downward from its said main intake bore with an annular upwardly facing shoulder at the juncture of said bores, the lower end of said reduced bore opening through the lower end of said body, said lower end of said body having a downwardly facing lower end sealing face circumscribing the lower end of said reduced bore, a poppet valve comprising a tubular stem reciprocable in said reduced bore, a poppet head on the lower end of said stem engageable with said sealing face, said stem having perforations therethrough just above said head, a bias spring normally yieldingly holding said poppet valve against said sealing face, a downwardly directed nozzle member having a divergent, frusto-conical spray discharge skirt joined to the lower end of said body, said skirt being positioned with its upper end region located vertically at substantially the level of the upper side of said poppet head when said poppet valve is seated against said sealing face, all in such manner that downward displacement of said poppet valve from its last-mentioned position enables radial discharge from perforations in said poppet valve stem against the interior upper end region of said skirt, and a circular array of downwardly and generally spirally oriented surface grooves sunk in the inside surface of said skirt to receive and convey said radially fed liquid downwardly in said grooves and downwardly and tangentially out the lower ends thereof, whereby to subdue splash from a container being filled from said nozzle.

2. The subject matter of claim 1, wherein said grooves comprise partial, generally cylindrical bores, but of expanding cross sectional area downwardly and outwardly, to compensate for increasing groove area in the radially outward direction.

* * * * *